United States Patent [19]

Seaton

[11] Patent Number: 5,060,985

[45] Date of Patent: Oct. 29, 1991

[54] LOCATION OF TUBULAR MEMBERS

[75] Inventor: Russell Seaton, Trowbridge, England

[73] Assignee: Cooper Industries, Inc., Houston, Tex.

[21] Appl. No.: 518,937

[22] Filed: May 4, 1990

[30] Foreign Application Priority Data

Aug. 14, 1989 [GB] United Kingdom ..... 8918517
Apr. 11, 1990 [EP] European Pat. Off. ..... 90303901.4

[51] Int. Cl.[5] ..... F16L 21/02
[52] U.S. Cl. ..... 285/141; 285/321
[58] Field of Search ..... 285/140, 141, 142, 143, 285/321, 24; 166/88, 86, 344

[56] References Cited

U.S. PATENT DOCUMENTS 1,530,960 3/1925 Tompkins .
3,273,915 9/1966 Bishop et al. ..... 285/140 X
3,287,035 11/1966 Greenwood ..... 285/147
3,288,493 11/1966 Brown ..... 285/140 X
3,289,765 12/1966 Hynes ..... 166/46
3,400,950 10/1968 Quebe et al. ..... 285/141 X
4,528,738 7/1985 Galle, Jr. ..... 285/141 X
4,909,546 3/1990 Noblileau ..... 285/141

*Primary Examiner*—Dave W. Arola
*Assistant Examiner*—Heather Chun
*Attorney, Agent, or Firm*—Jackie Lee Duke; Nelson A. Blish; Alan R. Thiele

[57] ABSTRACT

A landing ring (60, 96) for use in stacking hangers (14, 40, 80) in a wellhousing 10. Each landing ring can be connected to a downwardly facing landing shoulder on a layer in such a way as to allow relative lateral movement between the ring and layer. The lower surface of each ring may be tapered to engage a correspondingly shaped surface on the upper surface of another hanger on which it is to land. The arrangement points a layer to be aligned laterally in the housing independently of the alignment of a layer on which it is landed.

3 Claims, 2 Drawing Sheets

LOCATION OF TUBULAR MEMBERS

BACKGROUND

This invention relates generally to the location of tubular members one within another. The invention has particular, but not exclusive, application to the location of casing and tubing hangers within wellhead housings.

In the formation of wells for the extraction of oil or similar materials, it is the usual practice to run a series of concentric casings and tubings through a wellhead housing into a borehole which extends to the source of oil or other material. The casings and tubings are supported on hangers which are themselves carried within the wellhead housing. A first casing hanger usually rests upon a shoulder formed in the wellhead housing and subsequent hangers are stacked upon that casing hanger.

One way of stacking casing and tubing hangers on top of each other within a wellhead housing is to provide each hanger with a flat or square landing shoulder on which a corresponding flat surface of a subsequent hanger can land. Flat landing shoulders however have been found to be unacceptable, because they encourage the build-up of debris on those flat surfaces and this can lead to slight tilting of the hanger when it lands together with other problems such as an increased stack-up height. One way of avoiding debris build-up is to provide tapered hanger landing shoulders so that debris cannot settle easily on those shoulders. However, when tapered or conical landing shoulder are used subsequent hangers spigot into each other and hence tend to align both laterally and angularly with the hanger on which they are resting. Thus, any misalignment of a lower hanger tends to be amplified through the stacked hangers and this can lead to problems, particularly in connection with the sealing of upper hangers within the wellhead housing. Also where a Christmas Tree or tubing head adaptor is fitted to the top of a wellhead housing, it is usually necessary for this equipment to connect with a hanger which is as concentric as possible with the wellhead housing.

The H. K. V. Tompkins U.S. Pat. No. 1,530,960 discloses a split sleeve with a beveled upper face mating with a corresponding beveled lower face on a specially prepared casing collar which is used to suspend pipe. No provision for lateral movement is shown.

The J. A. Greenwood U.S. Pat. No. 3,287,035 shows a pipe hanger with a lower ring having a beveled surface seating on a complementary beveled surface in the casing head.

The J. H. Hynes U.S. Pat. No. 3,2889,765 discloses a casing support plate with a lower tapered surface engaging a tapered surface on an outer support flange.

SUMMARY

The present invention is concerned with a landing arrangement which alleviates or overcomes these problems.

One aspect of the present invention concerns a landing ring which comprises a generally annular member arranged and adapted to be secured to a downwardly facing surface of a hanger, such that the landing ring can undergo relative lateral movement at least to a limited extent with respect to the hanger. The landing ring may be connected to the hanger by means of an annular member carried on a cylindrical surface of the hanger. The annular member may comprise a washer which is held in position by a circlip carried on the hanger. Alternatively, the landing ring may be connected to the downwardly facing surface of the hanger by means of shoulder screws which extend through axially extending bores in the landing ring, the diameter of each bore being such as to provide a clearance between the screw and the wall of the bore.

Another aspect of the invention provides apparatus for use in locating a tubular member on a further tubular member suspended in a cylindrical housing, said apparatus comprising a generally annular member and means for locating said member against a lower mounting surface of the one tubular member so that it can undergo restricted lateral movement relative to the tubular member and said annular member having a surface for engaging a landing surface on the further tubular member. Preferably the landing surfaces are tapered or conical surfaces.

In an embodiment of the invention the one tubular member may be a tubing hanger and the further tubular member a casing hanger with the tubular housing being a wellhead housing.

An object of the present invention is to provide an apparatus which allows relative lateral movement of a casing or tubing hanger when landed on a previously deployed casing hanger.

Another object of the present invention is to provide an apparatus which allows a subsequently deployed casing or tubing hanger to land in a previously installed casing hanger while remaining concentric with the wellhead housing and thereby facilitating the installation of an annular sealing means.

BRIEF DESCRIPTION OF THE DRAWINGS

These and other objects and advantages of the present invention are set forth below and further made clear by reference to the drawings wherein.

DESCRIPTION OF THE PREFERRED EMBODIMENT

Figure 1:
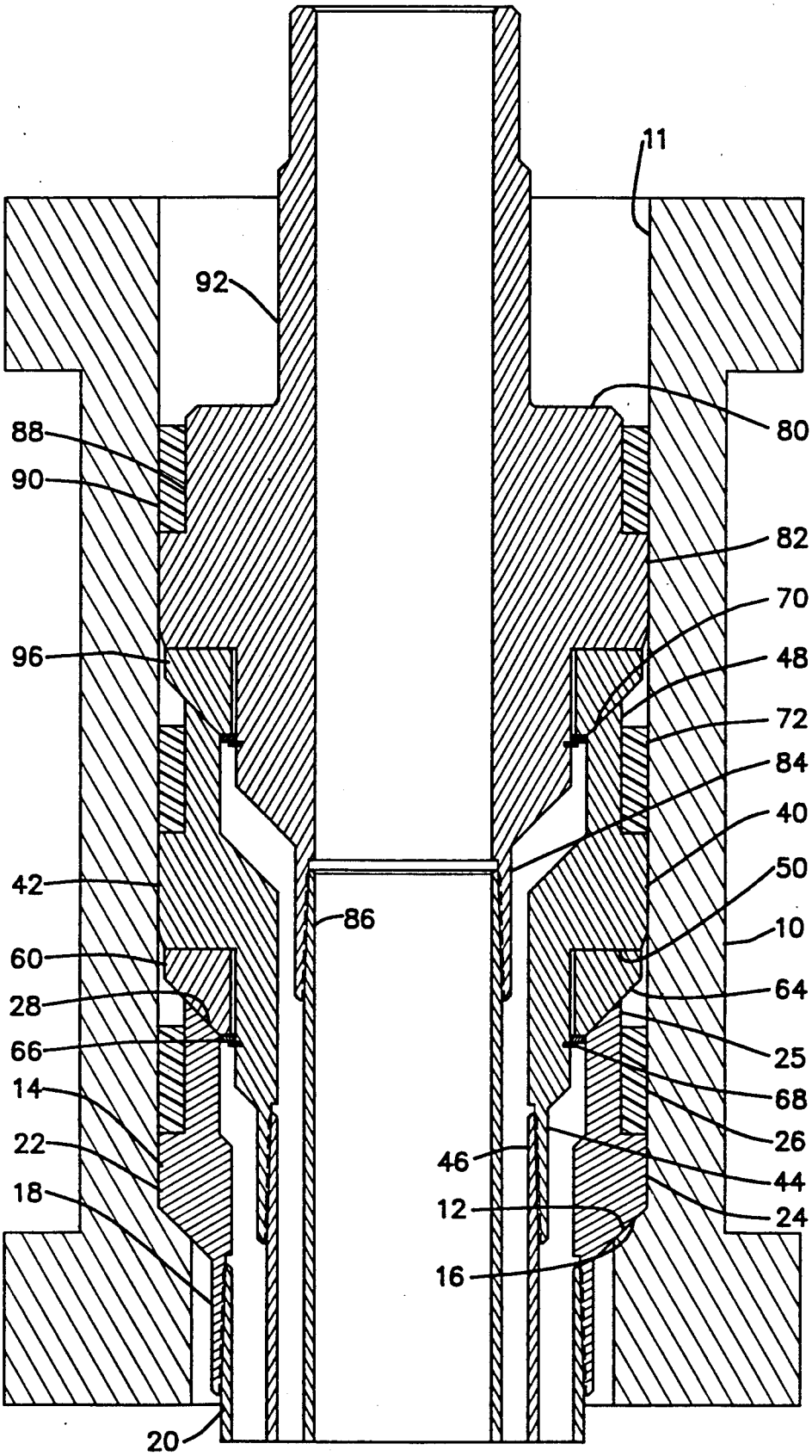
FIG. 1 is a sectional view of wellhead equipment incorporating an arrangement in accordance with the present invention.

With reference to FIG. 1, a generally tubular wellhead housing 10 having a through bore 11 is shown, the wall of the bore being formed towards its lower portion with an inwardly tapering shoulder 12. The downwardly tapering shoulder 12 forms a landing shoulder for a lower casing hanger 14 which has a downwardly facing tapering shoulder 16 on its outer cylindrical surfaces arranged to rest upon the shoulder 12. The casing hanger 1 also has a downwardly depending tubular part 18 which engages the upper end of a downwardly extending casing 20. The hanger 14 also has a relatively thick wall portion 22, the outer cylindrical surface 24 of which locates closely against the tubular bore 11 of the wellhead housing. The upper wall portion 25 of the hanger which extends upwardly from the relatively thick portion 22 is slightly thinner and its outer surface is spaced from the wall of the wellhead housing bore, thereby defining an annular space within which is located a casing hanger seal 26. The upper edge of the casing hanger 14 is tapered, as shown at 28, to define a frusto-conical surface.

A further upper casing hanger 40 is disposed in the wellhead housing and stacked upon the first or lower casing hanger 14. The upper casing hanger 40 has a relatively thick body portion 42, a downwardly depending generally tubular part 44 which engages a downwardly extending casing 46 and an upper tubular part 48 which is similar to the corresponding part 25 on the lower casing hanger 14. The relatively thick portion 42 defines a downwardly facing shoulder 50 against which is located a landing ring 60. The landing ring 60 is generally annular and has an upper flat surface which locates against the flat surface downwardly facing surface 50 of the shoulder of the upper casing hanger. The landing ring 60 has a downwardly tapering lower outer surface 64 which sits on the tapered surface 28 of the lower casing hanger 14. The landing ring is held in position on the upper casing hanger by means of a washer 66 which is held in position on the upper casing hanger by means of an annular circlip 68 which locates in an annular groove in the outer cylindrical surface of the hanger. The upper surface of the upper casing hanger has a tapered portion 70 which is similar to the tapered portion 28 on the lower casing hanger. Also, a seal 72 is disposed between the upper part 48 of the upper casing hanger and the wall of the wellhead housing bore.

In a similar manner a tubing hanger 80 is stacked upon the upper casing hanger 40. The tubing hanger has a relatively thick body portion 82, the outer surface of which can locate closely against the wall of the wellhead housing bore, a downwardly depending portion 84 which engages the upper end of a tubing 86, a portion 88 which extends upwardly from the portion 82 and whose thickness is slightly less than that of the portion 82, thereby defining an annular space within which can locate a tubing hanger seal 90, and an upper relatively thin wall portion 92. The lower surface of the relatively thick portion 82 defines a downwardly facing shoulder against which locates a landing ring 96 which has the same construction and is mounted in a similar manner to the landing ring 60.

It will be seen that the landing rings 60 and 96 have inner diameters which are greater than the outer diameter of the hanger portion about which they locate. This enables the hangers to undergo restricted lateral movement relative to the landing rings. Hence when, for example, the upper casing hanger 40 is stacked upon the lower casing hanger 14 by means of the landing ring 60, any mis-alignment of the lower casing hanger is not automatically transmitted to the upper casing hanger, because the upper casing hanger can move laterally relative to the landing ring 60 upon which it sits. A similar situation applies to the tubing hanger 80 which is mounted upon the landing ring 96 which in turn rests upon the shoulder 80 on the upper casing hanger.

A feature of the stacking arrangement described above is therefore that each successive hanger which is stacked within the wellhead housing can be aligned laterally within the wellhead housing bore substantially independently of the alignment of the hanger or hangers upon which it is stacked. This arrangement allows all hangers to be correctly aligned directly from the wellhead housing and this facilitates installation and setting of the seals 26, 72, and 90.

Figure 2:
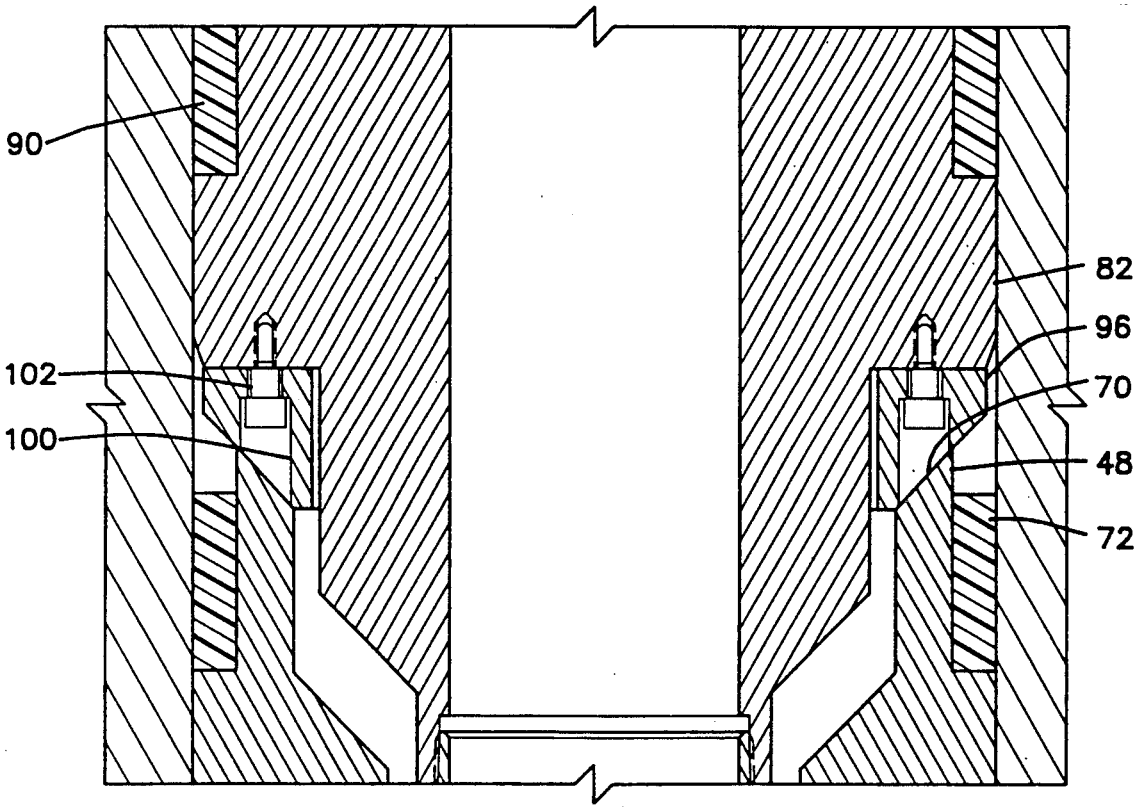
FIG. 2 is a sectional view of an alternate embodiment of the landing ring in accordance with the present invention.

FIG. 1 shows the landing ring supported on their respective hangers by means of washers and circlips. In an alternative arrangement the landing rings may be loosely attached to their hanger by means of shoulder screws. This arrangement is shown schematically in FIG. 2 where the landing ring, for example landing ring 96, is shown having stepped axial through bores 100 which receive shoulder screws 102 which in turn engage tapped bores formed within the tubing hanger. This arrangement allows the hanger to move laterally relative to the landing ring.

What is claimed is:

1. A landing ring comprising:

a generally annular member arranged and adapted to be secured to a downwardly facing surface of a hanger such that the landing ring can undergo relative lateral movement at least to a limited extend with respect to the hanger, said landing ring is connected to the hanger by means of an annular member carried on a cylindrical surface of the hanger, and said annular member comprises a washer which is held in position by a circlip carried on the hanger.

2. A landing ring comprising:

a generally annular member arranged and adapted to be secured to a downwardly facing surface of a hanger such that the landing ring can undergo relative lateral movement at least to a limited extent with respect to the hanger wherein the landing ring is connected to a downwardly facing surface of a hanger by means of shoulder screws which extend through axially extending bores in the landing trip, and the diameter of each bore being such as to provide a clearance between the screw and the wall of the bore.

3. A landing ring according to claim 2 wherein the lower surface of the ring is tapered to define a frusto-conical surface which can land on a correspondingly shaped surface on the upper end of another hanger.

* * * * *